US006370792B1

(12) United States Patent
Culp et al.

(10) Patent No.: US 6,370,792 B1
(45) Date of Patent: Apr. 16, 2002

(54) STRUCTURE AND METHODS FOR INTRODUCING HEATED ARI INTO A KILN CHAMBER

(75) Inventors: George R. Culp, 44091 Old Highway 52, New London, NC (US) 28127; Robert T. Nagel, 6309 Valley Estates Dr., Raleigh, NC (US) 27612

(73) Assignees: George R. Culp, New London, NC (US); Robert T. Nagel, Raleigh, NC (US)

( * ) Notice: Subject to any disclaimer, the term of this patent is extended or adjusted under 35 U.S.C. 154(b) by 0 days.

(21) Appl. No.: 09/653,625

(22) Filed: Sep. 1, 2000

(51) Int. Cl.[7] ..... F26B 21/06

(52) U.S. Cl. ..... 34/78; 34/396; 34/518; 34/218; 34/508

(58) Field of Search ..... 34/419, 423, 396, 34/518, 507, 508, 509, 510, 78, 218, 219, 223, 224, 225, 487, 213

(56) References Cited

U.S. PATENT DOCUMENTS

| | | | | | |
|---|---|---|---|---|---|
| 217,022 | A | | 7/1879 | Robbins | |
| 528,496 | A | | 10/1894 | Williams | |
| 942,150 | A | * | 12/1909 | Tiemann | 34/396 |
| 1,039,301 | A | | 9/1912 | Leaver | |
| 1,054,597 | A | * | 2/1913 | Moore | 34/213 |
| 1,108,377 | A | | 8/1914 | Leaver | |
| 1,268,180 | A | | 6/1918 | Tiemann | |
| 1,276,979 | A | * | 8/1918 | Sidman | 34/423 |
| 1,366,225 | A | | 1/1921 | Weiss | |
| RE15,316 | E | | 3/1922 | Weiss | |
| 1,432,248 | A | | 10/1922 | Hirt | |
| 1,461,393 | A | | 7/1923 | Jenkinson | |
| 1,467,306 | A | | 9/1923 | Carrier | |
| 1,539,817 | A | | 5/1925 | Thelen | |
| 1,543,344 | A | | 6/1925 | Thelen | |
| 1,594,549 | A | | 8/1926 | Noel | |
| 1,603,103 | A | | 10/1926 | Anderson | |
| 1,693,395 | A | * | 11/1928 | Lawton | 34/518 |
| 1,774,208 | A | | 8/1930 | Mueller | |
| 1,778,586 | A | | 10/1930 | Cobb | |
| 1,833,397 | A | | 11/1931 | Hagen | |

(List continued on next page.)

FOREIGN PATENT DOCUMENTS

| | | |
|---|---|---|
| CA | 699870 | 12/1964 |
| DE | 3321673 | 6/1983 |
| SU | 901772 | 2/1982 |

*Primary Examiner*—Teresa Walberg
*Assistant Examiner*—Fadi H. Dahbour
(74) *Attorney, Agent, or Firm*—Alston & Bird LLP

(57) ABSTRACT

A kiln system includes a kiln chamber defining a chamber interior space, a furnace capable of providing heated air, one or more air moving devices capable of circulating air in the chamber interior space along a recirculating flow path, and a plenum positioned in the kiln chamber and generally separating the chamber interior space into an upper portion and a lower portion. The upper portion of the chamber interior space that is positioned above the plenum, and the lower portion of the chamber interior space is positioned below the plenum and is capable of receiving the charge of lumber for drying. The plenum defines a plenum cavity that is in communication with and capable of receiving the heated air from the furnace. The kiln system further includes one or more upright passageways. Each upright passageway is mounted to the plenum and in communication with the plenum cavity so that the upright passageway is capable of receiving heated air from the plenum cavity. Each upright passageway extends into the upper portion of the chamber interior space and includes at least one outlet positioned proximate the recirculating flow path in the upper portion of the chamber interior space. As a result, each upright passageway is capable of providing heated air from the plenum to the recirculating flow path in the upper portion of the chamber interior space via its outlet.

33 Claims, 10 Drawing Sheets

U.S. PATENT DOCUMENTS 1,840,523 A 1/1932 Mueller
1,919,646 A 7/1933 Woolhouse
1,964,115 A 6/1934 Goodall
1,989,998 A 2/1935 Mueller
1,995,675 A 3/1935 Furbush
2,001,001 A 5/1935 Thelen
2,006,018 A 6/1935 Goodall
2,081,098 A 5/1937 Steel
2,085,634 A 6/1937 Cobb
2,318,027 A 5/1943 Sykes et al.
2,380,518 A 7/1945 Gottschalk et al.
2,538,888 A 1/1951 Smith
2,718,713 A 9/1955 Bloxham
2,736,108 A 2/1956 Muyderman
2,821,029 A 1/1958 Simons
2,825,274 A 3/1958 Kurth et al.
3,129,071 A 4/1964 Meredith
3,149,932 A 9/1964 Bachrich
3,337,967 A 8/1967 Smith
3,355,783 A 12/1967 Miller et al.
3,363,324 A 1/1968 Martin
3,367,040 A 2/1968 Vani
3,386,186 A 6/1968 Tiefenbach
3,417,486 A 12/1968 Vanicek
3,584,395 A 6/1971 Peters
3,659,352 A 5/1972 Cook
3,675,600 A 7/1972 Jones
3,680,219 A * 8/1972 Koch ..... 34/396
3,716,004 A 2/1973 Jones
3,757,428 A 9/1973 Runciman
3,808,703 A 5/1974 Kamiya
3,899,836 A 8/1975 Johnson
3,932,946 A 1/1976 Johnson
4,014,107 A 3/1977 Bachrich
4,098,008 A 7/1978 Schuette et al.
4,182,049 A 1/1980 Lestraden
4,250,629 A 2/1981 Lewis
4,343,095 A 8/1982 Rosen et al.
4,344,237 A 8/1982 Willington
4,380,877 A 4/1983 Poux
4,556,043 A 12/1985 Bratton
4,662,083 A 5/1987 Carter et al.
4,663,860 A * 5/1987 Beall ..... 34/396
4,683,668 A 8/1987 Hondzinski et al.
4,753,020 A 6/1988 Brunner
4,788,777 A * 12/1988 Davis ..... 34/518
4,862,599 A 9/1989 Brunner
4,955,146 A 9/1990 Bollinger
4,972,604 A * 11/1990 Breckenridge ..... 34/487
5,107,607 A 4/1992 Mason
5,195,251 A 3/1993 Gyurcsek et al.
5,226,244 A 7/1993 Carter et al.
5,276,980 A 1/1994 Carter et al.
5,414,944 A 5/1995 Culp et al.
5,416,985 A 5/1995 Culp
5,437,109 A 8/1995 Culp
5,488,785 A 2/1996 Culp
6,219,937 B1 * 4/2001 Culp et al. ..... 34/396
6,243,970 B1 * 6/2001 Culp et al. ..... 34/508

* cited by examiner

STRUCTURE AND METHODS FOR INTRODUCING HEATED ARI INTO A KILN CHAMBER

FIELD OF THE INVENTION

The present invention relates generally to kiln systems and, more particularly, to the introducing of heated air into a kiln chamber for drying lumber.

BACKGROUND OF THE INVENTION

Lumber which has recently been cut contains a relatively large percentage of water and is referred to as green lumber. Prior to being used in applications that demand good grades of lumber, the green lumber must be dried. Drying removes a large amount of water from the lumber and significantly reduces the potential for the lumber to become warped or cracked. Although lumber may be dried in the ambient air, kiln drying accelerates and provides increased control over the drying process.

FIG. 1 illustrates aspects of one type of conventional kiln system 20. The conventional kiln system 20 includes a kiln chamber 22 that receives a charge of lumber. The charge of lumber typically consists of two or more rectangular stacks of lumber 24. The kiln chamber 22 is a generally rectangular building that can be at least partially sealed to control the amount of air that is introduced to and exhausted from the kiln chamber. Hot air from a furnace 26 is forced through an inlet duct 28 to a plenum 30 that is positioned in an upper portion of the kiln chamber 22. The hot air is discharged from the plenum 30 to the interior of the kiln chamber 22 through multiple outlets 32 defined in the top panel of the plenum. Only a few of the outlets 32 are identified by their reference numeral in FIG. 1. The heated air supplied to the interior of the kiln chamber 22 is circulated by reversible fans 34 so that the heated air flows along a recirculating flow path that extends through the charge of lumber, during which time the air dries the lumber. The furnace 26 draws air from the interior of the kiln chamber 22 via a return duct system (not shown).

Whereas conventional kiln systems 20 of the type illustrated in FIG. 1 are functional, they operate at least somewhat inefficiently. For example, the momentum of the flow along the recirculating flow path is inefficiently sacrificed in order to accelerate the heated air discharged from the outlets 32 of the plenum 30. As another example, the heated air discharged from the outlets 32 of the plenum 30 is contemporaneously supplied to both the high and low pressure sides of the fans 34. Since the heated air has a higher specific volume than cooler air, the introduction of heated air on the low pressure side of the fans means that the fans must disadvantageously pass air having a relatively high specific volume, which is inherently less efficient than passing air having a lower specific volume. In addition, it is common in some conventional kiln systems for the heated air introduced into the kiln chamber not to mix well with the air flowing along the recirculating flow path, which can result in uneven and therefore inefficient drying of lumber.

Inefficiencies in kiln systems reduce the speed at which a charge of lumber can be dried, which can be disadvantageous since mill production depends upon the ability to dry lumber at a sufficient rate so that production need not be slowed to allow for the drying process. Inefficiencies in kiln systems also add to the cost of producing quality lumber. Of course it is advantageous to lower the cost of producing quality lumber. Whereas some conventional kiln systems can be characterized as being efficiently operated and able to dry lumber at a sufficient rate, there is always a demand for new kiln systems and kiln-related structures and methods that can be even more efficiently operated, and that facilitate the drying of lumber at a sufficient rate.

SUMMARY OF THE INVENTION

The present invention solves the above and other problems by providing improved structures and methods for introducing heated air into a kiln chamber.

In accordance with one aspect of the present invention, a kiln system includes a kiln chamber defining a chamber interior space, one or more air moving devices capable of circulating air in the chamber interior space along a recirculating flow path, a furnace capable of providing heated air, and a plenum positioned in the kiln chamber and generally separating the chamber interior space into upper and lower portions. The upper portion of the chamber interior space is positioned above the plenum, and the lower portion of the chamber interior space is positioned below the plenum and is for receiving a charge of lumber for drying. The plenum defines a plenum cavity for receiving the heated air from the furnace. The kiln system further includes one or more upright passageways that are operative for efficiently supplying the heated air from the plenum cavity to the upper portion of the chamber interior space. More specifically, each upright passageway is mounted to the plenum and in communication with the plenum cavity so that the upright passageway is capable of receiving heated air from the plenum cavity. Each upright passageway extends into the upper portion of the chamber interior space and includes at least one outlet positioned proximate the recirculating flow path in the upper portion of the chamber interior space. As a result, each upright passageway is capable of providing heated air from the plenum to the recirculating flow path in the upper portion of the chamber interior space via its outlet.

In accordance with one aspect of the present invention, the air moving devices are positioned in the upper portion of the chamber interior space and include impellers defining rotational axes. Preferably the outlets of the upright passageways are proximate hubs of the nearest respective impellers, which advantageously promotes mixing of the heated air discharged by the upright passageways.

In accordance with one aspect of the present invention, the upright passageways are constructed, arranged and operated so that the heated air discharged thereby is introduced proximate the flows being discharged by the air moving devices and in at least generally the same direction as the flows being discharged by the air moving devices. Preferably the heated air is discharged by the upright passageways at a speed that is at least approximately as great as the speed of the flow being discharged by the air moving devices. As a result and advantageously, the momentum of the flow along the recirculating flow path is not sacrificed in order to accelerate the heated air supplied to the chamber interior space by the upright passageways. Most preferably the heated air is discharged from the upright passageways at a speed that is substantially greater than the speed of the flow being discharged by the air moving devices, which advantageously enhances the flow through the air moving devices. In addition, the upright passageways are proximate the air moving devices so that the flow from the outlets advantageously reduces the pressure near the exits of the air moving devices by means of Bernoulli's principle, which also enhances the flow through the air moving devices.

In accordance with one aspect of the present invention, each upright passageway is constructed and arranged so as to minimize its contribution to the resistance to flow along the recirculating flow path. For each upright passageway, a first cross-dimension is generally perpendicular to the length of the upright passageway and parallel to the portion of the flow path into which the upright passageway extends, and a second cross-dimension is generally perpendicular to both the length of the upright passageway and the portion of the flow path into which the upright passageway extends. The second cross-dimension is less than the first cross-dimension, whereby the upright passageway advantageously defines a low profile with respect to the portion of the recirculating flow path into which the upright passageway extends.

In accordance with one aspect of the present invention, each air moving device is capable of operating in clockwise and counterclockwise modes. Flow along the recirculating flow path travels clockwise while the air moving devices operate in the clockwise mode. In contrast, flow along the recirculating flow path travels counterclockwise while the air moving devices operate in the counterclockwise mode. Each air moving device has opposite first and second sides. The first and second sides are respectively high and low-pressure sides during the clockwise mode. In contrast, the first and second sides are respectively low and high-pressure sides during the counterclockwise mode. A first group of the upright passageways is positioned so that the outlets thereof are proximate yet preferably facing away from the first sides of respective air moving devices. In contrast, a second group of the upright passageways is positioned so that the outlets thereof are proximate yet facing away from the second sides of respective air moving devices. The kiln system includes a control system that is operative so that the outlets of the first group of upright passageway are open and the outlets of the second group of upright passageways are closed while the air moving devices operate in the clockwise mode. In contrast, the control system is also operative so that the outlets of the first group of upright passageway are closed and the outlets of the second group of upright passageways are open while the air moving devices operate in the counterclockwise mode. As a result, heated air originating from the furnace and having a relatively high specific volume is advantageously introduced substantially solely at the high-pressure sides of the air moving devices, which is inherently more efficient than having the air moving devices pass the heated air having the relatively high specific volume.

In accordance with another aspect of the present invention, each upright passageway includes both an inboard outlet and an outboard outlet. For each upright passageway, the inboard outlet is oriented toward the respective air moving device and the outboard outlet is oriented away from the respective air moving device. In accordance with this aspect, the control system is operative so that the outboard outlets of the first group of upright passageways are open, the inboard outlets of the first group of upright passageways are closed, the outboard outlets of the second group of upright passageways are closed, and the inboard outlets of the second group of upright passageways are open while the fans operate in the clockwise mode. In contrast, the outboard outlets of the first group of upright passageways are closed, the inboard outlets of the first group of upright passageways are open, the outboard outlets of the second group of upright passageways are open, and the in board outlets of the second group of upright passageways are closed while the fans operate in the counterclockwise mode.

These and other aspects of the present invention are advantageous because they each pertain to the efficient operation and/or timely operation of kiln systems. In particular, the kiln system of the present invention permits heated air to be selectively injected into the recirculating flow path such that the heated air can be injected on the high-pressure sides of the air moving devices in a manner that facilitates mixing of the heated air with the circulating air without introducing substantial impedance into the recirculating flow path, and most preferably the heated air is injected in a manner that advantageously enhances flow along the flow path.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 2:
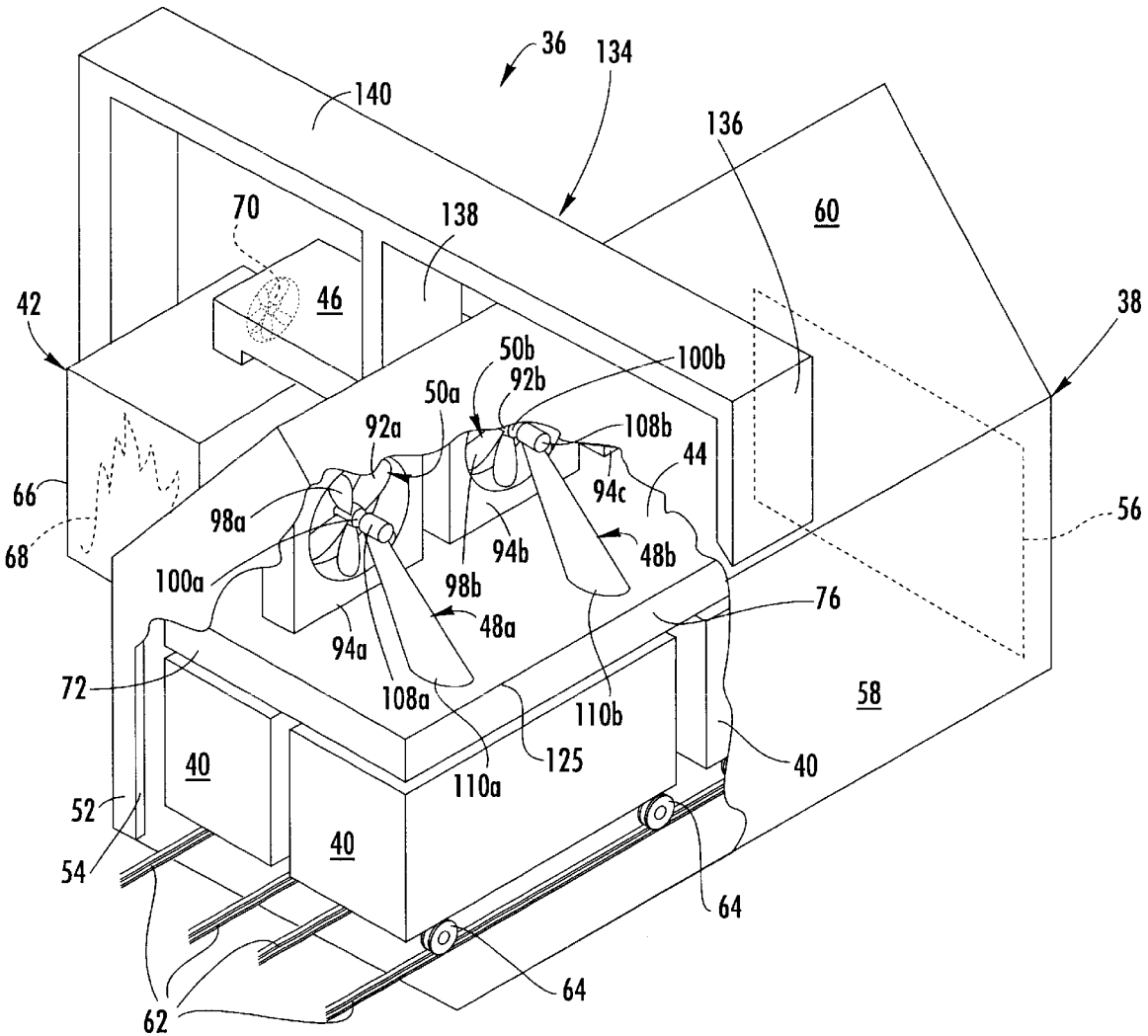
FIG. 2 is a partially schematic, partially cut away, pictorial view of portions of a kiln system, in accordance with a first embodiment of the present invention.

Referring to FIG. 2, a kiln system of a first embodiment of the present invention is designated generally at 36. The operation of the kiln system 36 will initially be very generally described, followed by separate sections that respectively describe details about structures of the kiln system of the first embodiment, assembly of the kiln system of the first embodiment, operation of the kiln system of the first embodiment, and a kiln system of a second embodiment. Some aspects of the present invention are described without regard to the sections, and the use of the sections is not intended to limit the scope of the present invention.

The kiln system 36 includes a kiln chamber 38 that receives a charge that includes one or more stacks of lumber 40. The kiln system 36 further includes a furnace 42 and a communication system that routes heated air from the furnace to the interior of the kiln chamber 38 to dry the charge of lumber. In accordance with the first embodiment, the communication system includes a plenum 44, one or more supply ducts 46 that that supply heated air from the furnace 42 to the plenum, and preferably multiple upright passageways 48*a–h* (FIGS. 2, 3 and 6–8) that supply heated air from the plenum to the interior space of the kiln chamber 38. However, other communication systems are within the scope of the present invention.

In accordance with the first embodiment, the upright passageways 48*a–h* are operative to discharge the heated air at positions that are proximate multiple air moving devices, such as a series of fans 50*a–d* (FIGS. 2, 3 and 6–7). The fans 50*a–d* are operated to circulate the heated air within the kiln chamber 38 to enhance the drying of the charge of lumber. The upright passageways 48*a–h* are preferably constructed, arranged and operated to advantageously enhance the operation of the fans 50*a–d* and the mixing of the heated air within the kiln chamber 38. On the other hand, the upright passageways 48*a–h* contribute to the resistance to the flow that is provided by the fans 50*a–d*. However, the upright passageways 48*a–h* are constructed and arranged to advantageously limit the resistance to flow caused thereby.

Structures of the Kiln System of the First Embodiment

Referring to FIG. 2, the kiln chamber 38 includes a front wall 52 and an opposite rear wall that is hidden from view in FIG. 2. The front wall 52 defines a front door opening 54 therethrough and carries front doors (not shown), typically in a pivotal or slideable fashion, that are used to open and close the front door opening. Similarly, the rear wall defines a rear door opening 56 therethrough that is hidden from view in FIG. 2, but is illustrated by broken lines. The rear wall carries rear doors (not shown), also typically in a pivotal or slideable fashion, that are used to open and close the rear door opening 56. A right side wall 58 and a left side wall, which is hidden from view in FIG. 2, extend in a longitudinal direction between the front wall 52 and the rear wall, and the walls carry a roof 60.

In accordance with the first embodiment, a transportation system is provided for moving stacks of lumber 40 into a lower portion of the kiln chamber 38 through the front door opening 54 for drying, and thereafter out of the kiln chamber through the rear door opening 56. It should be apparent, however, that the stacks of lumber 40 can be loaded and unloaded through the same door opening such that only one of the front wall 52 and rear wall includes a door opening, or alternatively a door opening could be in one or both side walls of the kiln chamber 38, if so desired.

As illustrated in FIG. 2, the transportation system that carries the charge of lumber includes two sets of tracks 62 upon which wheeled carriages travel. Only two of the wheels 64 of one of the wheeled carriages are seen in FIG. 2. The 62 tracks extend longitudinally through the lower portion of the kiln chamber 38, the front door opening 54, and the rear door opening 56. Each wheeled carriage carries a stack of lumber 40.

In accordance with the illustrated version of the first embodiment, a charge includes four stacks of lumber 40. However, the kiln system 36 is scaleable and in accordance with one embodiment of the present invention a smaller kiln system is provided for which a charge includes only a single stack of lumber 40. That is, kiln systems of various sizes and having various numbers of components are within the scope of the present invention. For example, the kiln system can incorporate more or less than eight upright passageways 48*a–h* (FIGS. 2, 3 and 6–8), and more or less than four fans 50*a–d* (FIGS. 2, 3 and 6–7).

The furnace 42 is diagrammatically illustrated in FIG. 2 and is preferably a suspension furnace. The furnace 42 includes a mixing chamber 66 in which combustible fuel is burned to create fire 68, which is illustrated by broken lines. The fire 68 creates combustion by-products that are mixed with heated air. The furnace 42 includes an air moving device 70 that moves the heated air and associated combustion by-products; therefore, in accordance with the first embodiment, "heated air" refers to the combination of the air heated by the furnace and the combustion by-products carried by that heated air. In accordance with another embodiment of the present invention, the furnace 42 includes a heat exchanger and is operated so that the air heated by the furnace is substantially absent of the combustion by-products created by the fire 68. Further, it is within the scope of the present invention for the furnace 42 to be of any type that is conventionally used to provide heated air to a plenum 44 that distributes the heated air.

Figure 3:
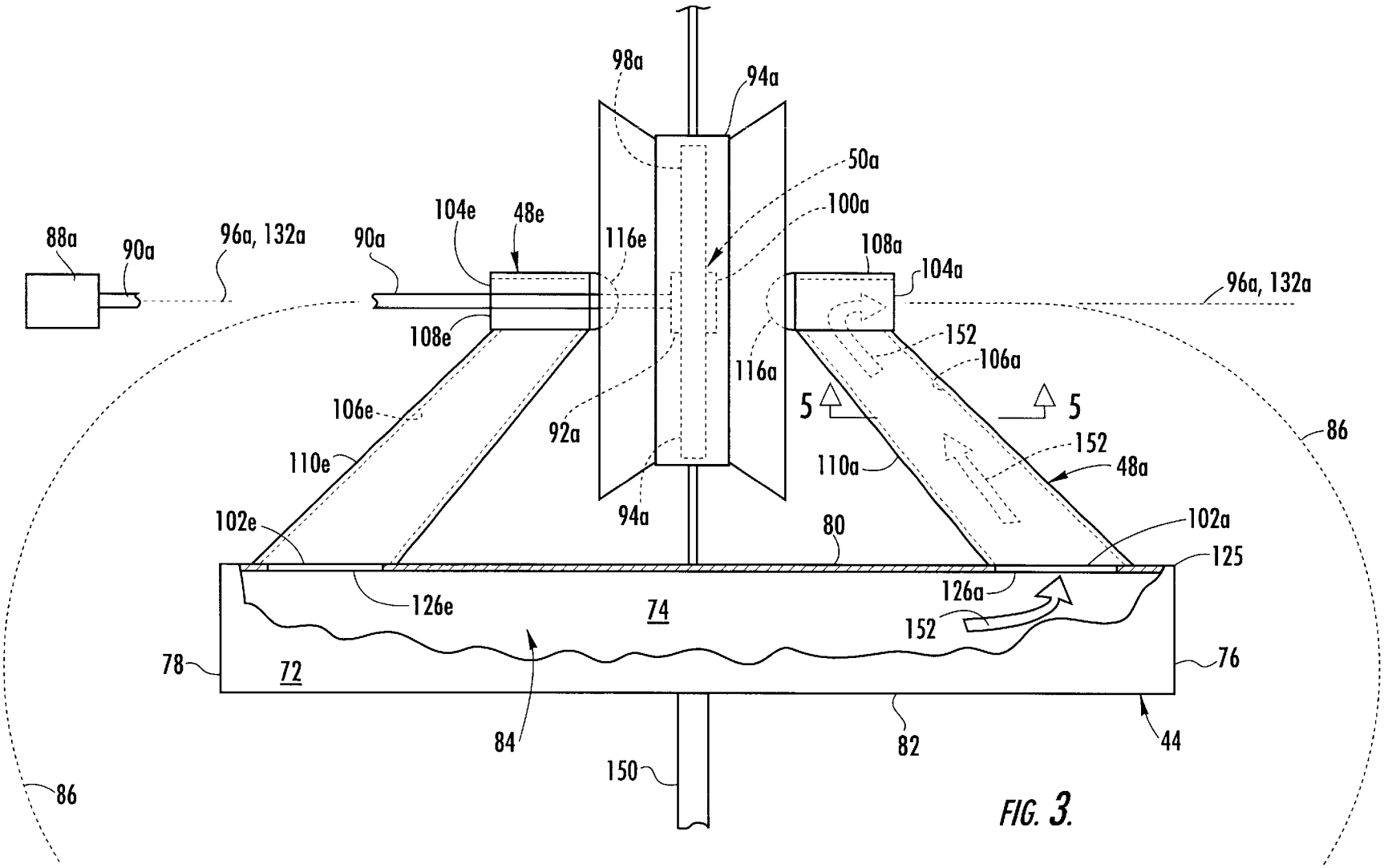
FIG. 3 is a partially schematic side elevation view of select components that are mounted within the interior space of a kiln chamber of the kiln system of FIG. 2.

Referring to FIGS. 2, 3 and 6–8, the plenum 44 includes generally vertical front and rear panels 72, 74 respectively positioned at the front and rear ends of the kiln chamber 38. The plenum 44 also includes generally vertically and longitudinally extending right and left panels 76, 78 that extend longitudinally between the front and rear panels 72, 74. The plenum 44 also includes generally horizontally and longitudinally extending top and bottom panels 80, 82 that are vertically spaced apart from one another and extend between the front and rear panels 72, 74. The panels 72, 74, 76, 78, 80, 82 of the plenum 44 cooperate to bound and define a plenum cavity 84 (FIG. 3). In accordance with the first embodiment, any section through the plenum 44 is generally rectangular, although differently shaped plenums are within the scope of the present invention. The plenum 44 extends above the charge of lumber and can be characterized as defining the boundary between upper and lower portions of the kiln chamber 38 (i.e., upper and lower portions of the chamber interior space.)

Referring to FIG. 2, the supply duct 46 is connected between and directs heated air from the furnace 42 to the plenum 44. More specifically, in accordance with the first embodiment, an upstream end of the supply duct 46 is connected to and in direct communication with the interior of the mixing chamber 66, and a downstream end of the supply duct is connected to the left panel 78 (FIGS. 3 and 6–8) of the plenum 44 and in direct communication with the plenum cavity 74 (FIG. 3).

Referring to FIG. 2, in accordance with the first embodiment, the fans 50*a–d* (FIGS. 2, 3 and 6–7) are positioned within the upper portion of the chamber interior space in a parallel arrangement that extends in the longitudinal direction. Referring to FIG. 3, the fans 50*a–d* are capable of providing a recirculating flow path 86 that extends around the plenum 44 and through the charge of lumber. The general center of the recirculating flow path 86 is schematically illustrated in FIG. 3 by a line made up of a repeating series of two short dashes alternating with one long dash. The fans 50*a–d* are reversible and can be operated so that the air within the upper and lower portions of the chamber interior space moves either in a clockwise direction along the recirculating flow path 86 or a counterclockwise direction along the recirculating flow path. Throughout the Detailed Description of the Invention section of this disclosure, FIG. 3 is the frame of reference with respect to which flow in the clockwise and counterclockwise directions is defined. The direction of operation of the fans 50*a–d* is periodically reversed during the drying of a charge of lumber because reversing the flow helps to uniformly dry the charge of lumber.

The fan 50*a* is representative of the fans 50*b–d* and will be described with reference to FIG. 3, in which a portion of the representative fan 50*a* is hidden from view and therefore shown in broken lines. The fan 50*a* includes a motor 88*a* that rotates a drive shaft 90*a*. The housing of the motor 88*a* is rigidly mounted within the kiln chamber 38 and the drive shaft 90*a* is rotatably carried by bearings (not shown). Whereas the motor 88*a* is illustrated as being inline with the drive shaft 90*a* in FIG. 3, the motor need not be inline with the drive shaft and can drive the drive shaft by way of a drive belt or any other type of conventional arrangement. An impeller 92*a* of the fan 50*a* is rigidly mounted to the end of the drive shaft 90*a* and is positioned within a shroud 94*a* that extends around the impeller. The motor 88*a* is operative to rotate the drive shaft 90*a* and therefor the impeller 92*a*. Accordingly, the impeller has a rotational axis 96*a* that dictates the general direction in which the air moved by the fan 50*a* initially travels. The interior wall of the shroud 94*a* extends around and is generally coaxial with the rotational axis 96*a*. The impeller 92*a* includes multiple blades 98*a* that extend radially away from a centrally located hub 100*a* that is coaxial with the rotational axis 96*a*. In accordance with the first embodiment, the rotational axes 96*a–d* (FIG. 8) of all of the impellers 92*a–d* (FIGS. 6–7) are parallel and extend in a common horizontal plane. Only portions of the drive shafts 90*a–d* are illustrated in FIG. 8.

An upright passageway 48*a* that is at least generally representative of each of the upright passageways 48*b–h* (FIGS. 2, 3 and 6–8) will now be described with reference to FIG. 3, in accordance with the first embodiment. In accordance with the first embodiment, the construction of each of the upright passageways 48*a–h* are identical in isolation, and the relationship between the upright passageway 48*a* and its respective fan 50*a* is generally representative of the relationship between the upright passageways 48*b–h* and their respective fans 50*b–d*.

As will be discussed in greater detail below with reference to the operation of the kiln system 36, the construction and arrangement of the representative upright passageway 48*a* provides advantages with respect to the introduction of heated air into the kiln chamber 38. On the other hand, the upright passageway 48*a* contributes to the resistance to flow along the recirculating flow path 86 since it extends into the recirculating flow path. However, and as will also be discussed in greater detail below with reference to the operation of the kiln system 36, the construction and arrangement of the upright passageway 48*a* advantageously limits the resistance to flow along the recirculating flow path.

The representative upright passageway 48*a* defines an inlet 102*a*, an outboard outlet 104*a*, and an internal passage 106*a* that extends between and provides a communication path from the inlet 102*a* to the outboard outlet 104*a*. The passage 106*a* is hidden from view in FIG. 3 and is therefor illustrated with dashed lines. The upright passageway 48*a* includes a generally cylindrical and somewhat pipe-like upper conduit 108*a* that defines the outboard outlet 104*a* and a downstream portion of the passage 106*a*. The upper conduit 108*a* is mounted to the top of a somewhat pipe-like lower conduit 110*a* that defines the inlet 102*a* and an upstream portion of the passage 106*a*.

Figure 4:
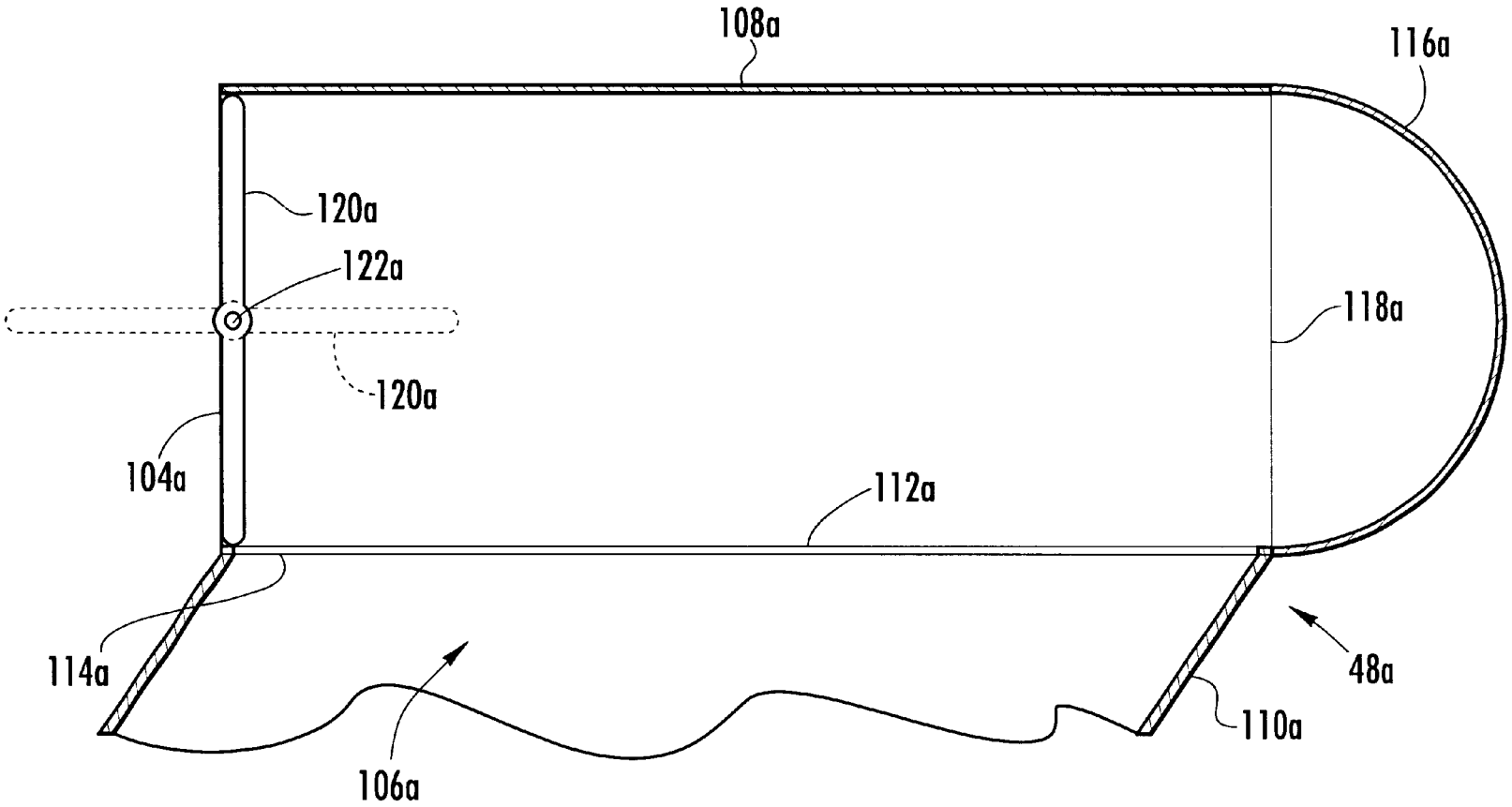
FIG. 4 is a partially schematic, partially sectional view of a portion of a representative upright passageway of the kiln system of FIG. 2, taken along line 4—4 of FIG. 8.

Referring to FIG. 4 and further regarding the representative upright passageway 48*a*, the bottom of the upper conduit 108*a* defines a lower opening 112*a* and the upper end of the lower conduit 110*a* defines an upper opening 114*a*, and the upper and lower conduits 108*a*, 110*a* are mounted to one another so that the lower and upper openings 112*a*, 114*a* are in direct communication and there is preferably no leakage from the passage 106*a* at the junction of the upper and lower conduits 108*a*, 110*a*. In accordance with the first embodiment, the upper conduit 108*a* can be constructed from a pipe-like piece of cylindrical material that is originally open at its opposite ends, that is cut to form the lower opening 112*a*, and that has a deflector 116*a* mounted to one end thereof to completely close an inboard outlet 118*a* that is opposite from the outboard outlet 104*a*. In accordance with the first and second embodiments of the present invention, each inboard outlet (for example see the inboard outlet 118*a*) is positioned between its respective outboard outlet (for example see the outboard outlet 104*a*) and fan (for example see the fan 50*a* of FIGS. 2, 3 and 6–7). In the first embodiment, the deflector 116*a* is arcuate, and most preferably the deflector is a half sphere that is arranged to efficiently deflect airflow that travels along the recirculating flow path 86 (FIG. 3) toward the deflector.

Referring to FIG. 4 and further regarding the representative upright passageway 48*a*, in accordance with the first embodiment, an outboard damper 120*a* is mounted for pivoting within the upper conduit 108*a* to open and close the outboard outlet 104*a*. In FIG. 4, the outboard damper 120*a* is illustrated in its closed position by solid lines, and in its open position by broken lines. The outboard damper 120*a* is carried by a pivot rod 122*a* having opposite ends carried by opposite sides of the upper conduit 108*a*. The outboard damper 120*a* is pivoted between its open and closed configurations by a damper control system (not shown, but for example see the damper control system 124 illustrated in FIG. 11, because those of ordinary skill in the art will appreciate that portions thereof can be utilized as the damper control system of the first embodiment). A variety of different dampers and damper control systems therefor for alternately blocking and allowing flow through the passageway 106a are within the scope of the present invention.

Referring to FIG. 3 and further regarding the representative upright passageway 48*a*, in accordance with the first embodiment, the lower end of the lower conduit 110*a* is mounted to the top panel 80 of the plenum 44 proximate a peripheral edge 125 of the top panel 80 that is distant from the fans 50*a–d* (FIGS. 2, 3 and 6–8). The top panel 80 of the plenum 44 defines an outlet 126*a* and the lower end of the lower conduit 110*a* is mounted to the top panel so that the outlet 126*a* of the plenum and the inlet 102*a* of the lower conduit 110*a* are in direct communication and there is preferably no leakage from the passage 106*a* at the junction between the lower conduit 110*a* and the plenum.

The lower conduit 110*a* of the representative upright passageway 48*a* tapers from being relatively wide at its lower end to being relatively narrow at its upper end. The upper end of the lower conduit 110*a* is proximate the fan 50*a*, so that the lower conduit 110*a* extends angularly from proximate the edge 125 of the plenum 44 to proximate the fan 50*a*.

Figure 5:
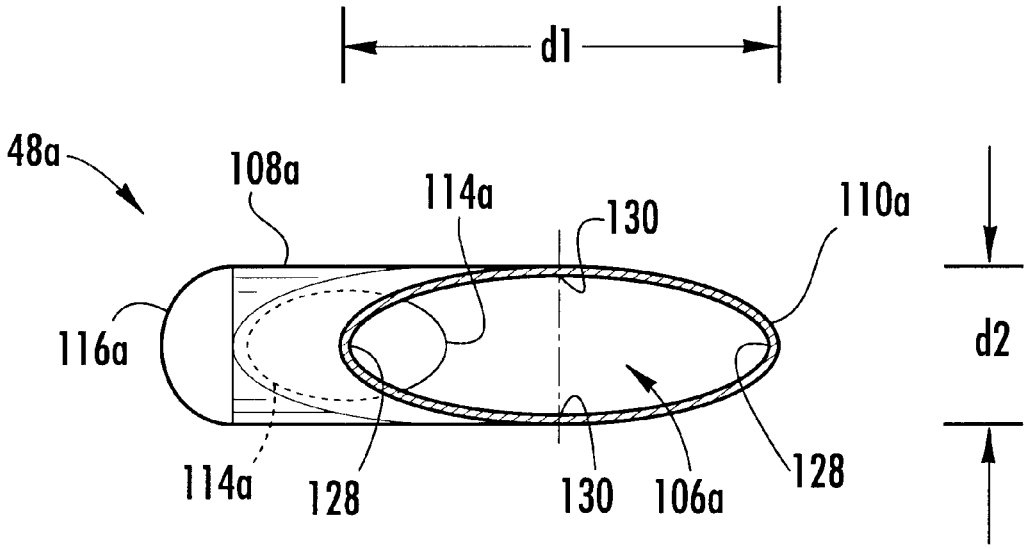
FIG. 5 is a partially schematic cross-sectional view of a portion of the representative upright passageway taken along line 5—5 of FIG. 3.

In accordance with the first embodiment, the lower conduit 110*a* of the representative upright passageway 48*a* advantageously defines a relatively low profile with respect to flow along the recirculating flow path 86 (FIG. 3). Referring to FIG. 5, in accordance with the first embodiment, the lower conduit 110*a* is elliptical in a cross-section thereof taken generally perpendicular to the length thereof, although other shapes are also within the scope of the present invention, such as oblong shapes, and the like. The lower conduit 110*a* can be characterized as including a pair of major vertices 128 that define a major cross-dimension d1 therebetween. Further, the lower conduit 110*a* can be characterized as including a pair of minor vertices 130 defining a minor cross-dimension d2 therebetween. The major cross-dimension d1 is preferably at least two times greater than the minor cross-dimension d2.

A kiln system of an alternative embodiment is identical to the kiln system 36 of the first embodiment, except for variations noted and variations that will be apparent to those of ordinary skill in the art. In accordance with this alternative embodiment, each lower conduit 110*a–h* (FIGS. 2, 3 and 6–8) is in the form of an upright cylindrical pipe, or the like, that can even be exactly vertically oriented if desired, and each of the upper conduits 108*a–h* is a pipe bend or elbow, or the like. Upright passageways 48*a–h* having other shapes are also within the scope of the present invention.

Referring to FIGS. 2, 3 and 6–8, in accordance with the first embodiment, the upright passageways 48*a–h* are arranged so that each of the deflectors thereof (for example see the deflectors 116*a,* 116*e* in FIG. 3, which are primarily hidden from view and are therefore illustrated by broken lines) is proximate a hub 100*a–d* of a respective fan 50*a–d*. As may best be understood by referring primarily to FIG. 8, most preferably and for each upper conduit 108*a–h,* its deflector is oriented toward and its outboard outlet (for example see the outboard outlets 104*a,* 104*e* in FIG. 3) is oriented away from the respective hub 100*a–d,* its outboard outlet is positioned within a predetermined radial distance from the rotational axis 96*a–h* of the respective hub, and its outboard outlet is positioned within a predetermined axial distance from the respective impeller 92*a–d*. In accordance with the first embodiment, the predetermined radial distance is approximately equal to the magnitude of the radius of the respective impeller 92*a–d,* and the predetermined axial distance is approximately equal to the magnitude of the diameter of the respective impeller.

Referring to FIG. 8 and in accordance with the first embodiment, each of the upper conduits 108*a–d* and its outboard outlet (for example see the outboard outlets 104*a,* 104*e* in FIG. 3) defines a respective discharge axis 132*a–h* that generally dictates the direction in which the discharged heated air initially travels. In accordance with the first embodiment, the discharge axes 132*a–d* of the right upright passageways 48*a–d* are respectively coaxial with the rotational axes 96*a–d* of the impellers 92*a–d,* and the discharge axes 132*e–h* of the left upright passageways 48*e–h* are respectively parallel and proximate the rotational axes 96*a–d* of the impellers 92*a–d*. In FIG. 8 the rotational axes 96*a–d* are represented by lines made up of solely short dashes, and the discharge axes 132*a–h* are represented by lines made up of a series of two short dashes alternating with one long dash. It is preferred, but not required, for all of the discharge axes 133*a–h* to be respectively coaxial with the rotational axes 96*a–d,* but in accordance with the first embodiment exceptions are made to compensate for obstructions, as will be discussed in greater detail below.

Figure 1:
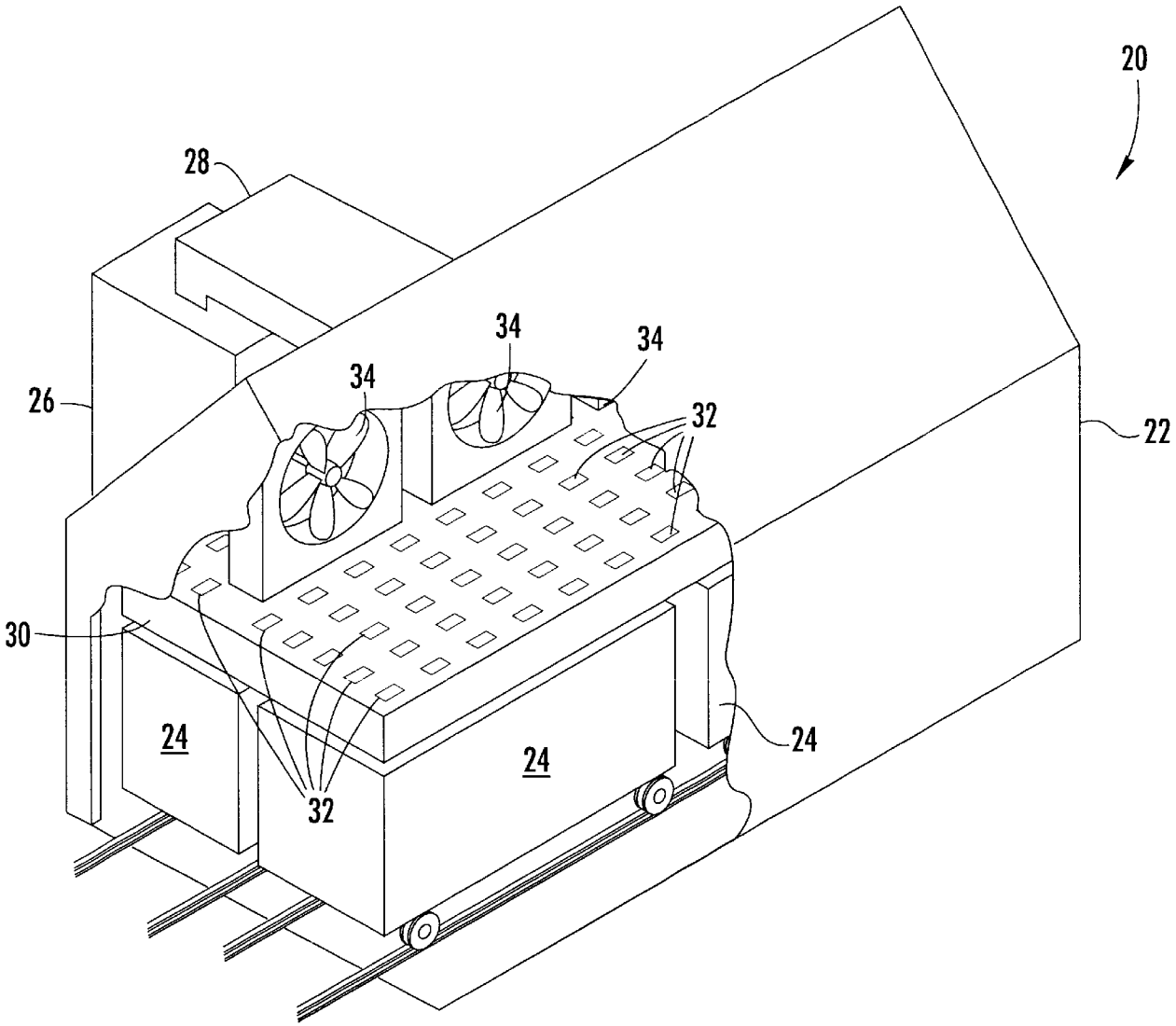
FIG. 1. (PRIOR ART)
FIG. 1 is a partially schematic, partially cut away, pictorial view of portions of a conventional kiln system.

Referring to FIG. 2, a return duct assembly 134 directs air from the upper portion of the chamber interior space to the furnace 42. Whereas the return duct assembly 134 might be characterized as not being important with respect to the methods and apparatus described herein for introducing heated air to the kiln chamber 38, the return duct assembly is nonetheless described herein for the sake of completeness. Whereas only a single return duct assembly 134 is illustrated in FIG. 1, in accordance with some embodiments of the present invention it is preferred to included multiple of such return duct assemblies, and other types of return duct assemblies are within the scope of the present invention. As illustrated in FIG. 2, the return duct assembly 134 includes a right return duct 136 and a left return duct 138, both of which have upstream ends that are mounted to the roof 60 and are in direct communication with the upper portion of the chamber interior space. The right return duct 136 joins the left return duct 138 and a downstream duct 140 to form a tee. The downstream duct 140 provides the communication path from the right and left return ducts 136,138 to the mixing chamber 66 of the furnace 42.

Figure 9:
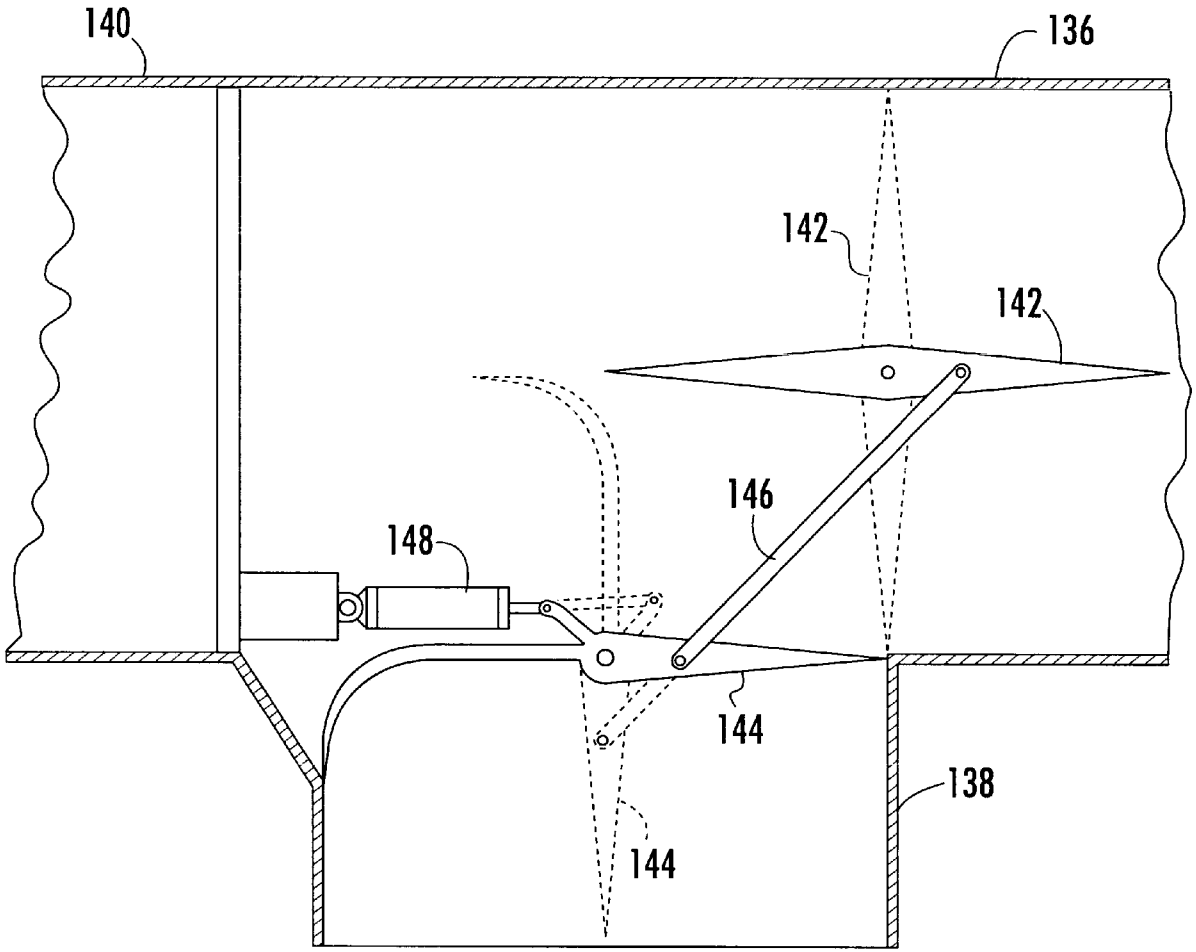
FIG. 9 is a partially schematic, sectional view of a tee that is formed by return ducts of the kiln system of FIG. 2 and contains a damper system.

Different arrangements can be utilized for operating the return duct assembly 134. Referring to FIG. 9 and in accordance with the first embodiment, a right return damper 142 is positioned in the right return duct 136 at the tee. Similarly, a left return damper 44 is positioned in the left return duct 138 at the tee. Each of the dampers 142, 144 are centrally pivotally mounted and moveable between the positions indicated by solid and broken lines in FIG. 9. In addition, a linkage 146 is connected between and links the dampers 142, 144, and a piston actuator 148 is mounted within the tee and connected to the left return damper. The piston actuator 148 is operated and the linkage 146 is operative so that the dampers 142, 144 move together between the positions illustrated by solid lines and the positions illustrated by broken lines. Accordingly, the right return duct 136 is in communication with and the left return duct 138 is not in communication with the mixing chamber 66 of the furnace 42 via the downstream duct 140 while the dampers 142, 144 are in the positions illustrated by solid lines. In contrast, the right return duct 136 is not in communication with and the left return duct 138 is in communication with the mixing chamber 66 via the downstream duct 140 while the dampers 142, 144 are in the positions illustrated by broken lines.

Figure 6:
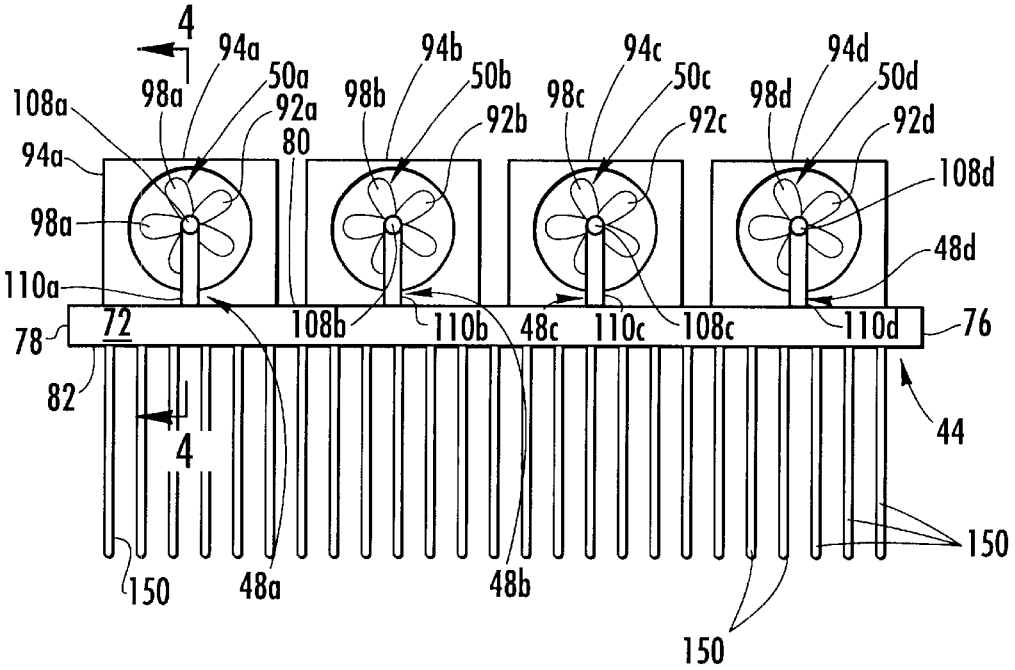
FIG. 6 is a right elevation view of select components that are mounted within the interior space of the kiln chamber of the kiln system of FIG. 2.
Figure 7:
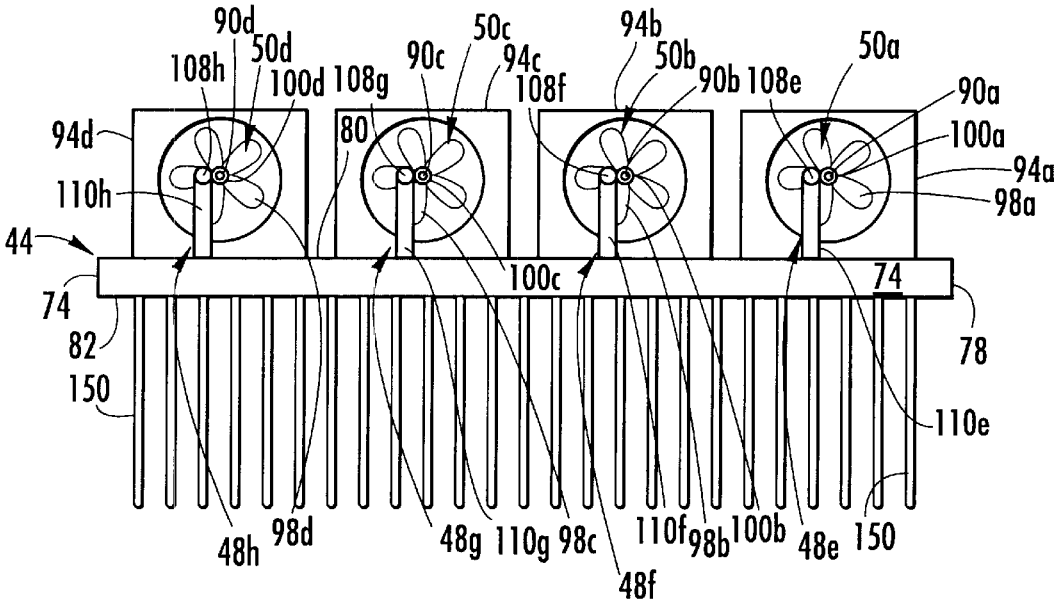
FIG. 7 is a left elevation view of select components that are mounted within the interior space of the kiln chamber of the kiln system of FIG. 2.
Figure 8:
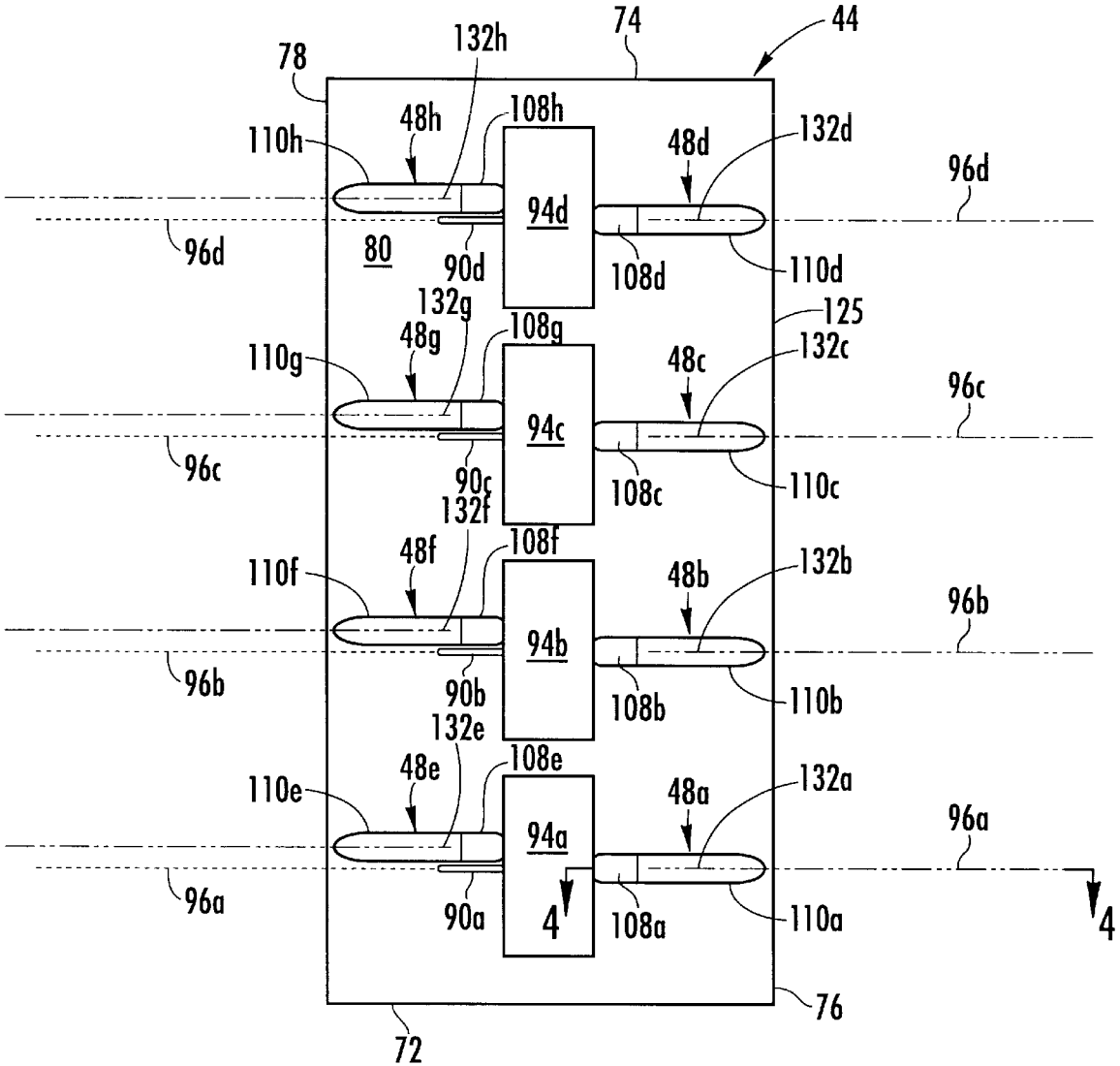
FIG. 8 is a partially schematic top plan view of select components that are mounted within the interior space of the kiln chamber of the kiln system of FIG. 2.

As illustrated in FIGS. 3 and 6–7 and in accordance with the first embodiment, multiple conventional reheater conduits 150 are mounted to and depend vertically from the lower wall 82 of the plenum 44. Only a representative few of the reheater conduits 150 are identified by their reference numeral in FIGS. 6–7. The reheater conduits 150 direct heated air from the plenum cavity 84 (FIG. 3) to the lower portion of the chamber interior space in a conventional manner. More specifically, each reheater conduit 150 defines a series of vertically spaced apart apertures (not shown) along its length that provide communication paths from the plenum cavity 84 to the lower portion of the chamber interior space. As best understood with reference to FIG. 2, in accordance with the first embodiment, the reheater conduits 150 are arranged in a single longitudinally extending row that is centered between the right and left stacks of lumber 40. In accordance with another embodiment of the present invention, the reheater conduits 150 are as described in the U.S. patent application filed on Mar. 30, 2000 in the name of George R. Culp et al. and entitled Improved Reheaters for Kilns, Reheater-Like Structures, and Associated Methods, which is incorporated herein by reference. This patent application also incorporates by reference the U.S. patent application filed on Mar. 22, 2000 in the name of Robert T. Nagel et al. and entitled Improved Kiln System and Kiln-Related Structures, and Associated Methods.

Construction of the Kiln System of the First Embodiment

The kiln system 36 (FIG. 2) of the first embodiment is advantageously particularly well suited for being constructed by modifying/retrofitting a preexisting kiln system, such as the conventional kiln system 20 of FIG. 1; however, it is also within the scope of the present invention for the kiln system 36 to be constructed from scratch. For example and in accordance with the first embodiment, retrofitting operations performed to convert the conventional kiln system 20 illustrated in FIG. 1 into the kiln system 36 of the first embodiment include first through third operations described immediately below. First and referring to FIG. 1, the outlets 32 of the plenum 30 are closed such as by closing dampers associated therewith or welding plates over them, or the like. Second, series of appropriate outlets (for example see the outlets 126*a,* 126*e* of FIG. 3) are formed in the upper panel of the plenum 30 so that it becomes generally like the plenum 44 of the kiln system 36 of the first embodiment. Third, upright passageways 48*a–h* are mounted so that they are arranged as described above to provide the kiln system 36.

The first through third operations described immediately above with respect to the retrofitting operations that are performed to convert the conventional kiln system 20 into the kiln system 36 of the first embodiment are exemplary in nature and are not intended to provide an exhaustive description of operations that are necessary to perform the complete conversion. Additionally, the first through third operations described immediately above with respect to the retrofitting operations of the present invention are not intended to give the impression that the first through third operations illustrate the only differences between the conventional kiln system 20 and the kiln system 36. In view of this disclosure those of ordinary skill in the art will appreciate that the retrofitting operations necessary to convert suitable conventional kiln systems into a kiln system 36 will include further operations such as, but not necessarily limited to, installing a control system for controlling the operation of the upright passageways 48*a–h.*

When mounting the upright passageways 48*a–h* to the plenum 44, it is most preferred for the upper passageways to be respectively centered with the fans 50*a–d* so that the discharge axes 132*a–h* are respectively coaxial with the rotational axes 96*a–d.* However, when retrofitting or even when constructing from scratch it can be necessary to avoid obstructions, such as the drive shafts 90*a–d* of the fans 50*a–d,* when mounting the upright passageways 48*a–h.* For example, in accordance with the illustrated version of the first embodiment, the slightly off-center placement of the left upright passageways 48*e–h* is due to the obstructing arrangement of the drive shafts 90*a–d.*

Operation of the Kiln System of the First Embodiment

The kiln system 36 operates in a manner that dries a charge of lumber in an efficient and timely manner. The basic operation of the kiln system 36 will now be described, in accordance with the first embodiment, with occasional reference to exemplary advantageous aspects of the kiln system. Advantageous aspects of the kiln system 36 include, but are not limited to, those that enhance the operation of the fans 50*a–d,* that reduce flow-related losses within the kiln chamber 38, that optimize heat utilization within the kiln chamber, and that that promote the uniform drying of the charge of lumber. Although some of the aspects of the kiln system 36 are described in the context of a single advantage, those of ordinary skill in the art will appreciate that at least some of the recited advantages are not independent of one another. Further, this disclosure is not intended to provide an exhaustive list of all of the advantages provided by the present invention.

The kiln system 36 is readied for operation by using the transportation system to placing a charge of green lumber within the lower portion of the chamber interior space by way of the front door opening 54. Thereafter, front and rear doors are closed to respectively close the front and rear door openings 54, 56. In addition, other openings (not shown) of the kiln chamber are closed so that the interior space of the kiln chamber is generally enclosed. Some leakage of air into and out of the interior space of the kiln chamber is desired, however, so that moisture escapes from the interior space of the kiln chamber 38 and ambient air is drawn into the interior space of the kiln chamber.

After the interior space of the kiln chamber 38 is generally sealed with a charge of green lumber therein, the furnace 42 is operated so that heated air is supplied to the interior space of the kiln chamber and the fans 50*a–d* are operated to move the heated air along the recirculating flow path 86. In accordance with one aspect of the kiln system 36, the direction of operation of the fans 50*a–d* is periodically reversed while a charge of lumber is being dried, which promotes the uniform drying of the charge of lumber. Each fan 50*a–d* is operated in a manner that promotes clockwise flow along the recirculating flow path 86 during a clockwise mode. For each fan 50*a–d,* the right side thereof is the high-pressure or discharge side and the left side thereof is the low-pressure or intake side during the clockwise mode. Likewise, each fan 50*a–d* is operated in a manner that promotes counterclockwise flow along the recirculating flow path 86 during a counterclockwise mode. For each fan 50*a–d,* the left side thereof is the high-pressure or discharge side and the right side thereof is the low-pressure or intake side during the counterclockwise mode.

In accordance with another aspect of the kiln system 36, operation of the fans 50*a–d* is optimized by operating the damper control system so that heated air is provided to the upper portion of the chamber interior space substantially solely by either the right upright passageways 48*a–d* or the left upright passageways 48*e–h.* More specifically, the damper control system is operated so that the outboard dampers (for example see the outboard damper 120*a* in FIG. 4) of the right upright passageways 48*a–d* are in their open configurations and the outboard dampers of the left upright passageways 48*e–h* are in their closed configurations while the fans 50*a–d* operate in the clockwise mode. As a result, any amount of heated air supplied to the upper portion of the chamber interior space through the outboard outlets (for example see the outboard outlet 104*e* in FIG. 3) of the left upright passageways 48*e–h* is substantially less than the amount of heated air supplied to the upper portion of the chamber interior space through the outboard outlets (for example see the outboard outlet 104*a* in FIG. 3–4) of the right upright passageways 48*a–d* during the clockwise mode. In contrast, the outboard dampers of the right upright passageways 48*a–d* are in their closed configurations and the outboard dampers of the left upright passageways 48*e–h* are in their open configurations while the fans 50*a–d* operate in the counterclockwise mode. As a result, any amount of heated air supplied from right upright passageways 48*a–d* is substantially less than the amount of heated air supplied to the upper portion of the chamber interior space through the left upright passageways 48*e–h* during the counterclockwise mode. As a result, heated air originating from the furnace 42 and having a relatively high specific volume is advantageously introduced substantially solely to the high-pressure sides of the fans 50*a–d,* which is inherently more efficient than having the fans pass the heated air having the relatively high specific volume.

As a representative example, FIG. 3 includes arrows 152 that illustrate flow through the upright passageway 48*a* during clockwise flow along the recirculating flow path 86. As the arrows 152 illustrate, the upper conduit 108*a* functions as a turning mechanism so that the flow of heated air received by the inlet 102*a* of the representative upright passageway 48*a* flows in a first direction and the flow of heated air discharged by the outlet 104*a* flows in a second direction that is different from the first direction.

As a result of the design of the kiln system 36, a jet-like flow of heated air is discharged from the open outlets (for example see the outboard outlets 104*a,* 104*e* in FIG. 3) while the kiln system 36 is operating. During operation of the kiln system 36, the jet-like flow is approximately steady and of steady state. In accordance with one acceptable example, the jet-like flow from each of the open outlets of the upright passageways 48*a–h* is a flow of heated air with a circular cross section and a velocity of the order of 200 feet per second, and in contrast the flow discharged from each of the fans 50*a–d* has a velocity of the order of 25 feet per second.

Advantageously, operation of the fans 50*a–d* is optimized by the jet-like flows of heated air that are discharged by the upright passageways 48*a–h.* Due to the strategic opening and closing of the outboard dampers as described above for the first embodiment, the jet-like flows always originate proximate the discharge sides of the fans 50*a–d.* As also described above for the first embodiment, the outboard outlets are respectively proximate the fans 50*a–d* and oriented so that all of the discharge axes 132*a–h* of the outboard outlets are directed at least generally parallel to the rotational axes 96*a–h* of the fans, and the flow discharged from the upright passageways 48*a–h* preferably has a velocity greater than the flow discharged by the fans 50*a–d.* Stated differently, the jet-like flow from the outboard outlets that are open has relatively great momentum that is mostly parallel to the rotational axes 96*a–d,* and all of that momentum is in the downstream direction, which is the direction of flow defined by the exit velocity of the fans 50*a–d.* Accordingly, the momentum of the flow along the recirculating flow path 86 is advantageously not sacrificed in order to accelerate the hot gas supplied by the upright passageways 48*a–h,* i.e., the flow along the recirculating flow path does not have to turn the hot gas supplied by the upright passageways. In accordance with the first embodiment, any momentum exchange is such that the exit flow from the fans 50*a–d* experiences an increase in momentum in the downstream direction. More specifically, in accordance with first embodiment, the hot gas introduced through the open outboard outlets augments the flow from the fans 50*a–d* and serves to increase the velocity along the recirculating flow path 86 so that the velocity along the recirculating flow path is greater while the fans are operating and hot air is introduced through the open outboard outlets than when the fans are operating and hot air is not supplied through the outboard outlets.

In accordance with the first embodiment, the open outboard outlets are in sufficiently close proximity to the fans 50*a–d* to reduce the pressure near the exits of the fans by means of Bernoulli's principle, thus further assisting the operation of the fans. That is, the static pressure near the jet-like flow discharged by the upright passageways 48*a–h* is low because the velocity of the jet-like flow is high. That low pressure is proximate the exits of the fans 50*a–d* and provides a venturi effect at the exits of the fans. That venturi effect provides a slight suction to the exits of the fans 50*a–d* which enhances the operation of the fans. In accordance with the first embodiment, this suction is provided in part by virtue of the open outboard outlets being positioned within predetermined radial and axial distances from their respective fans 50*a–d.* In accordance with the first embodiment, the predetermined radial distance is approximately equal to the magnitude of the radius of the respective impeller 92*a–d,* and the predetermined axial distance is approximately equal to the magnitude of the diameter of the respective impeller.

The upright passageways 48*a–h* are advantageously constructed and arranged so as to minimize flow related losses in the upper portion of the chamber interior space. For example and referring to FIG. 5, for each of the upright passageways 48*a–h,* the major cross-dimension d1 thereof is generally parallel to the portion of the recirculating flow path 86 through which the upright passageway extend. As a result, the upright passageways 48*a–h* define a relatively "low profile" with respect to flow along the recirculating flow path 86. As an additional example, for each upright passageway 48*a–h,* the portion thereof that is proximate the respective hub 100*a–d* is in the form of a smooth deflector (for example see the deflectors 116*a,* 116*e* of FIG. 3), and the flow discharged from a fan is relatively small in the vicinity of its hub. In addition, the upright passageways 48*a–h* respectively extend axially and radially away from the rotational axes 96*a–d* of the impellers 92*a–d* so as to minimally interfere with the flow being discharged by the fans 50*a–d.*

In accordance with another aspect of the kiln system 36, mixing of the heated air within the upper portion of the chamber interior space is facilitated by the arrangement of the outboard outlets. The flow entering and exiting each of the impellers 92*a–d* travels along a spiral path because of the influence of the rotation of the impellers. For each fan 50*a–d,* by virtue of the upright passageways 48*a–h* respectively introducing the heated air proximate the hubs 100*a–d* of the impellers 92*a–d,* the heated air flows along the spiral paths followed by the air being discharged from the fans so that mixing is facilitated.

In accordance with the first embodiment of the present invention, the return duct assembly 134 is operated so the air moving device 70 of the furnace 42 draws only relatively cool air from the interior space of the kiln chamber 38 to the mixing chamber 66, which optimizes heat utilization within the kiln system. More specifically, the return dampers 142, 144 are operated so that the left return duct 138 is open and the right return duct 136 is closed during the clockwise mode. As a result, the air moving device 70 draws air into the mixing chamber 66 of the furnace 42 from the left portion of the upper portion of the chamber interior space during the clockwise mode. In contrast, the return dampers 142, 144 are operated so that the right return duct 136 is open and the left return duct 138 is closed, during the counterclockwise mode. As a result, the air moving device 70 draws air into the mixing chamber 66 from the right portion of the upper portion of the chamber interior space during the counterclockwise mode.

In accordance with the first embodiment, the air moving device 70 in the mixing chamber 66 of the furnace 42 operates/rotates in the same direction during both the clockwise and counterclockwise modes.

In accordance with one example, after a charge of green lumber has been dried within the lower portion of the chamber interior space, at least the rear doors are opened and the dried charge of lumber is removed from the lower portion of the chamber interior space through the rear door opening 56.

The above and other aspects of the kiln system are advantageous because they are pertinent to the efficient operation and/or timely operation of the kiln system 20.

Kiln System of the Second Embodiment

Figure 10:
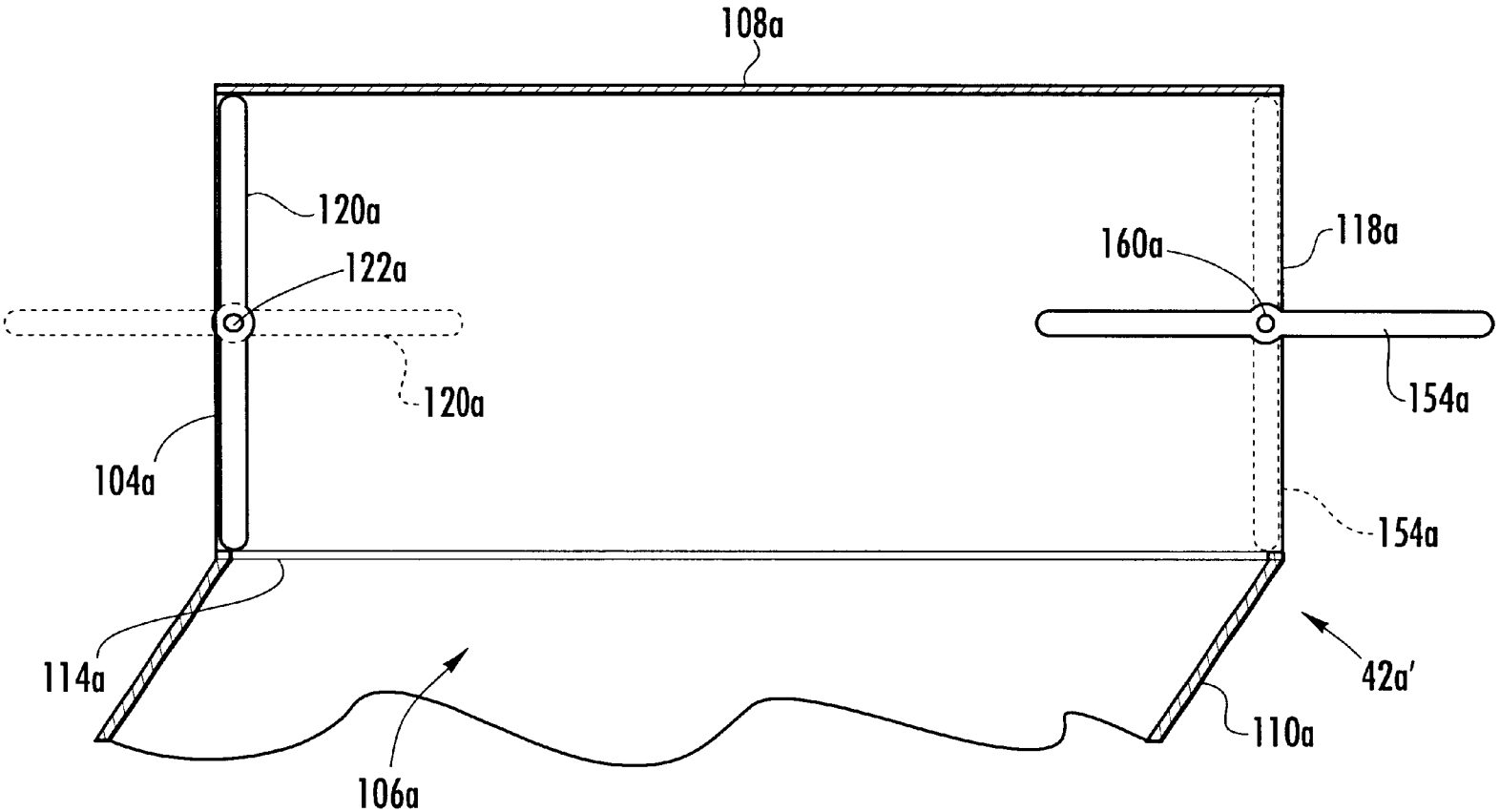
FIG. 10 is a partially schematic, partially sectional view of a portion of a representative upright passageway taken from a perspective similar to that of FIG. 4, in accordance with a second embodiment of the present invention.

A kiln system of a second embodiment of the present invention is identical to the kiln system 20 of the first embodiment, except for variations noted and variations that will be apparent to those of ordinary skill in the art. A representative upright passageway 42*a*' will now be described with reference to FIG. 10, in accordance with the second embodiment. In accordance with the second embodiment, the upper conduit 108*a* does not include a deflector (for example see the deflector 116*a* in FIG. 4), and the inboard outlet 118*a* can be opened and closed by an inboard damper 154*a* that is mounted for pivoting within the upper conduit 108*a*. The inboard and outboard dampers 154*a,* 120*a* are generally identical in that each is mounted for pivoting within the upper conduit 108*a,* 104*a* to open and close its respective outlet 118*a,* 104*a*. In FIG. 10, the outboard damper 120*a* is illustrated in its closed position by solid lines, and in its open position by broken lines; and the inboard damper 154*a* is illustrated in its open position by solid lines, and in its closed position by broken lines.

Figure 11:
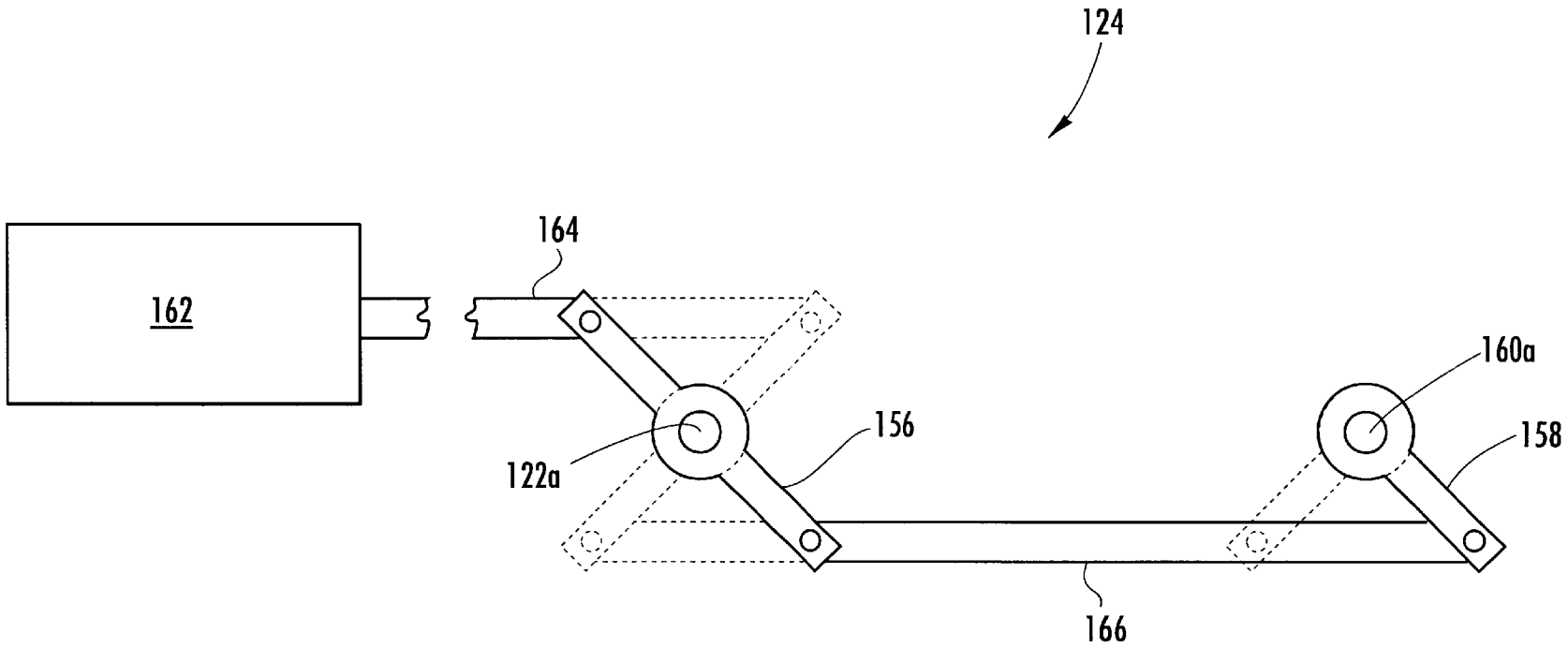
FIG. 11 schematically illustrates a representative portion of a control system operative for opening and closing outlets of the representative upright passageway of FIG. 10.

Further regarding the representative upright passageway 42*a*', the inboard and outboard dampers 154*a,* 120*a* are pivoted between their open and closed configurations by a damper control system so that while the outboard damper is open the inboard damper is closed, and visa versa. FIG. 11 schematically illustrates portions of a representative damper control system 124, in accordance with the second embodiment. Brackets 156, 158 are positioned outside of the upper conduit 108*a* (FIG. 10) and are respectively mounted to ends of the pivot rods 122*a,* 160*a* (FIG. 10) that extend outwardly from a side of the upper conduit. In accordance with the second embodiment, the damper control system 124 further includes a piston actuator 162 that is mounted and includes a movable push rod 164. The push rod 164 is connected to and moves the bracket 156. A control rod 166 links the brackets 156, 158. As a result, the piston actuator 162 can be operated to contemporaneously pivot the outboard and inboard dampers 120*a,* 154*a* between their open and closed configurations. For example, the configuration illustrated by solid lines in FIG. 11 represents the configuration of the damper control system 124 in which the inboard damper 154*a* is closed and the outboard damper 120*a* is open. In contrast, the configuration illustrated by broken lines in FIG. 11 represents the configuration of the damper control system 124 in which the inboard damper 154*a* is open and the outboard damper 120 is closed.

In accordance with the second embodiment, one or more damper control systems 124 are operated so that heated air is contemporaneously provided to the upper portion of the chamber interior space by both the right and left upright passageways (for example see the upright passageway 42*a*' in FIG. 10). More specifically, the outboard dampers (for example see the outboard damper 120*a* in FIG. 10) of the right upright passageways are open, the inboard dampers (for example see the inboard damper 154*a* in FIG. 10) of the right upright passageways are closed, the outboard dampers of the left upright passageways are closed, and the inboard dampers of the left upright passageways are open while the fans 50*a–d* operate in the clockwise mode. In contrast, the outboard dampers of the right upright passageways are closed, the inboard dampers of the right upright passageways are open, the outboard dampers of the left upright passageways are open, and the inboard dampers of the left upright passageways are closed while the fans operate in the counterclockwise mode. The kiln system of the second embodiment can advantageously provide a large volume of heated air to the upper portion of the chamber interior space without requiring an increase in the number or size of the upright passageways.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A kiln system for drying a charge of lumber, the kiln system comprising:

a kiln chamber defining a chamber interior space;

a furnace capable of providing heated air;

a plenum positioned in the kiln chamber and generally separating the chamber interior space into an upper portion that is positioned above the plenum and a lower portion that is positioned below the plenum and is capable of receiving the charge of lumber for drying, wherein the plenum defines a plenum cavity that is in communication with and capable of receiving the heated air from the furnace;

an air moving device capable of circulating air in the chamber interior space along a flow path; and a passageway mounted to the plenum and in communication with the plenum cavity so that the passageway is capable of receiving heated air from the plenum cavity, wherein the passageway extends into the upper portion of the chamber interior space and comprises an outlet positioned proximate the flow path in the upper portion of the chamber interior space so that the passageway is capable of providing heated air from the plenum to the flow path in the upper portion of the chamber interior space.

2. A kiln system according to claim 1, wherein:

the air moving device is positioned in the upper portion of the chamber interior space and comprises an impeller defining a rotational axis, and the outlet defines a discharge axis along which the heated air supplied from the outlet at least initially flows, and the discharge axis is at least approximately parallel to the rotational axis.

3. A kiln system according to claim 1, wherein the air moving device is positioned in the upper portion of the chamber interior space and comprises an impeller defining a rotational axis, the outlet is positioned within a distance from the rotational axis, and the distance from the rotational axis is approximately equal to the magnitude of the radius of the impeller.

4. A kiln system according to claim 1, wherein the passageway comprises a turn so that the heated air flows in a first direction through the passageway and the flow of heated air discharged by the outlet flows in a second direction that is different from the first direction.

5. A kiln system according to claim 1, wherein the passageway defines:

a first cross-dimension that is generally perpendicular to the length of the passageway and parallel to the portion of the flow path into which the passageway extends, and a second cross-dimension that is generally perpendicular to both the length of the passageway and the portion of the flow path into which the passageway extends, wherein the second cross-dimension is less than the first cross-dimension, whereby the passageway defines a low profile with respect to the portion of the flow path into which the passageway extends.

6. A kiln system according to claim 1, wherein the outlet is proximate the air moving device.

7. A kiln system according to claim 6, wherein:

the air moving device is positioned in the upper portion of the chamber interior space and comprises an impeller comprising a hub, and the outlet is proximate the hub.

8. A kiln system according to claim 6, wherein the plenum comprises a peripheral edge that is distant from the air moving device, and the passageway is mounted to the plenum proximate the peripheral edge.

9. A kiln system according to claim 1, wherein:

the passageway is a first passageway;

the kiln system further comprises a second passageway mounted to the plenum and in communication with the plenum cavity so that the second passageway is capable of receiving heated air form the plenum cavity;

the second passageway extends into the upper portion of the chamber interior space and comprises an outlet positioned proximate the flow path in the upper portion of the chamber interior space so that the second passageway is capable of providing heated air from the plenum to the flow path in the upper portion of the chamber interior space;

the air moving device is capable of operating in at least first and second modes, wherein:

flow along the flow path travels in a first direction while the air moving device operates in the first mode, flow along the flow path travels in a second direction that is opposite from the first direction while the air moving device operates in the second mode, and the air moving device has opposite first and second sides that are respectively:

high and low-pressure sides during the first mode and, low and high-pressure sides during the second mode;

the first passageways is positioned so that the outlet thereof is proximate the first side of the air moving device;

the second passageways is positioned so that the outlet thereof is proximate the second side of the air moving device; and the kiln system further comprises a control system operative so that:

the outlet of the first passageway is open and the outlet of the second passageway is closed while the fan operates in its first mode, and the outlet of the second passageway is open and the outlet of the first passageway is closed while the fan operates in its second mode.

10. A kiln system according to claim 1, wherein:

the outlet is a first outlet;

the passageway further comprises a second outlet positioned oppositely from the first outlet and proximate the flow path in the upper portion of the chamber interior space so that the passageway is capable of providing heated air from the plenum to the flow path via each of the first and second outlets;

the air moving device is capable of operating in:

a first mode so that flow along the flow path travels in a first direction, and a second mode so that flow along the flow path travels in a second direction that is opposite from the first direction; and the kiln system further comprises a control system operative so that:

the first outlet is open and the second outlet is closed while the fan operates in its first mode, and the second outlet is open and the first outlet is closed while the fan operates in its second mode.

11. A kiln system, comprising:

a kiln chamber defining an upper portion of a chamber interior space;

an outlet positioned in and in communication with the upper portion of the chamber interior space;

a furnace in communication with the outlet and capable of providing heated air to the outlet so that heated air is supplied to the upper portion of the chamber interior space via the outlet; and an air moving device positioned in the upper portion of the chamber interior space and comprising an impeller defining a rotational axis, wherein the air moving device is capable of moving air within the upper portion of the chamber interior space along a flow path that at least initially extends generally along the rotational axis, and wherein the outlet defines a discharge axis along which the heated air supplied from the outlet at least initially flows, and the discharge axis is at least approximately parallel to the rotational axis.

12. A kiln system according to claim 11, wherein the discharge axis and the rotational axis are approximately coaxial.

13. A kiln system according to claim 11, wherein the discharge axis and the rotational axis are spaced apart from one another.

14. A kiln system according to claim 11, further comprising a plenum, wherein the plenum is positioned between the furnace and the outlet so that the furnace is in communication with and capable of supplying the heated air to the plenum, and the plenum is in communication with and capable of providing heated air to the outlet so that heated air is supplied to the upper portion of the chamber interior space via the outlet, and wherein in a top plan view of the plenum the outlet is positioned within the periphery of the plenum.

15. A kiln system for drying a charge of lumber, the kiln system comprising:

a kiln chamber defining a chamber interior space capable of receiving the charge of lumber for drying;

an outlet positioned in and in communication with the chamber interior space;

a furnace in communication with the outlet and capable of providing heated air to the outlet so that heated air is supplied to the chamber interior space via the outlet; and an air moving device positioned in the chamber interior space and comprising an impeller defining a rotational axis about which the impeller is capable of rotating to move air within the chamber interior space along a flow path that at least initially extends generally along the rotational axis, and wherein the outlet is positioned within a distance from the rotational axis, and the distance from the rotational axis is approximately equal to the magnitude of the impeller.

16. A kiln system according to claim 15, wherein the outlet is positioned within a distance from the impeller, and the magnitude of the distance from the impeller is approximately equal to the magnitude of the diameter of the impeller.

17. A kiln system according to claim 15, further comprising a plenum, wherein the plenum is positioned between the furnace and the outlet so that the furnace is in communication with and capable of supplying the heated air to the plenum, and the plenum is in communication with and capable of providing heated air to the outlet so that heated air is supplied to the chamber interior space via the outlet, and wherein in a top plan view of the plenum the outlet is positioned within the periphery of the plenum.

18. A kiln system for drying a charge of lumber, the kiln system comprising:

a kiln chamber defining a chamber interior space capable of receiving the charge of lumber for drying;

an air moving device that is capable of operating in at least first and second modes, wherein:

the air moving device provides a flow path within the chamber during both the first and second modes, flow along the flow path travels in a first direction while the air moving device operates in the first mode, flow along the flow path travels in a second direction that is opposite from the first direction while the air moving device operates in the second mode, and the air moving device has opposite first and second sides that are respectively:

high and low-pressure sides during the first mode and, low and high-pressure sides during the second mode;

a furnace capable of providing heated air; and a communication system operative to provide heated air from the furnace to proximate the high-pressure side of the air moving device so that any amount of heated air supplied from the furnace to the low-pressure side of the air moving device is substantially less than the amount of heated air supplied from the furnace to the high-pressure side of the air moving device during both the first and second modes of operation.

19. A kiln system according to claim 18, wherein the furnace comprises a mixing chamber in which fuel is combusted so that within the mixing chamber air is heated and combustion by-products are created and mixed with the heated air, so that the heated air supplied from the furnace to the high-pressure side of the air moving device contains the combustion by-products.

20. A kiln system for drying a charge of lumber, the kiln system comprising:

a kiln chamber defining a chamber interior space capable of receiving the charge of lumber for drying;

a furnace capable of providing heated air;

a plenum in communication with the furnace so that the plenum is capable of receiving the heated air from the furnace;

an air moving device capable of circulating air in the chamber interior space along a flow path;

a plurality of passageways in communication with the plenum, wherein each passageway:

has opposite ends, defines a length that extends between the opposite ends and into at least a portion of the flow path, comprises an outlet positioned proximate the flow path so that the passageway is capable of providing heated air from the plenum to the flow path via the outlet, defines a first cross-dimension that is generally perpendicular to the length of the passageway and parallel to the portion of the flow path into which the passageway extends, and defines a second cross-dimension that is generally perpendicular to both the length of the passageway and the portion of the flow path into which the passageway extends, wherein the second cross-dimension is less than the first cross-dimension, whereby the passageway defines a low profile with respect to the portion of the flow path into which the passageway extends.

21. A kiln system according to claim 20, wherein for each passageway a cross-section thereof taken perpendicular to the length thereof is generally elliptical and defines a pair of first vertices between which the first cross-dimension is defined and a pair of second vertices between which the second cross-dimension is defined.

22. A passageway capable of being mounted to a plenum of a kiln system and for directing heated air out of the plenum, the passageway comprising:

opposite first and second ends, wherein the first end is for being mounted to the plenum;

an inlet proximate the first end and for receiving a flow heated air from the plenum; and an outlet proximate the second end, wherein the passageway defines a passage therethrough and the outlet is in communication with the inlet via the passage so that the outlet is for discharging the flow of heated air received by the inlet, and wherein a cross section of the passageway defines:

a first cross-dimension that is generally perpendicular to the length of the passageway, and defines a second cross-dimension that is generally perpendicular to both the length of the passageway and the first cross-dimension, wherein the second cross-dimension is less than the first cross-dimension.

23. A passageway according to claim 22, wherein the passageway defines a turn so that the flow of heated air received by the inlet flows in a first direction and the flow of heated air discharged by the outlet flows in a second direction that is different from the first direction.

24. A passageway according to claim 22, wherein the passageway further comprises a mechanism operative for controllably restricting and allowing flow through at least a portion of the passage.

25. A passageway according to claim 22, wherein the passageway further comprises:

a first conduit that defines a portion of the passage and the outlet; and a second conduit having opposite ends and defining a portion of the passage and the first and second cross-dimensions, wherein the inlet is defined by one end of the second conduit and the first conduit is mounted to the other end of the second conduit so that an angle is defined between the first and second conduits.

26. A passageway according to claim 25, further comprising a damper pivotably mounted thereto and operative for controllably restricting and allowing flow through at least a portion of the passage.

27. A passageway according to claim 25, further comprising a deflector comprising a generally arcuate exterior surface, wherein the first conduit has opposite ends, the outlet is proximate one of the ends of the first conduit and the deflector is mounted to the other end of the first conduit.

28. A method of operating a kiln system, the method comprising:

introducing a charge of lumber into a kiln chamber;

circulating heated air within the kiln chamber along a flow path extending through the charge of lumber, with the circulating comprising operating at least one air moving device so that the air moving device discharges a flow of air; and introducing heated air proximate the flow being discharged by the air moving device and in at least generally the same direction as the flow being discharged by the air moving device, wherein the introducing of the heated air comprises introducing the heated air at a speed that is at least approximately as great as the speed of the flow being discharged by the air moving device, whereby the momentum of the flow along the flow path is not sacrificed in order to accelerate the heated air introduced proximate the flow being discharged by the air moving device.

29. A method according to claim 28, wherein:

the circulating comprises alternately operating at least the air moving device to move air in a first direction along the flow path and to moving air along the flow path in a second direction that is opposite from the first direction; and the introducing heated air comprises:

introducing the heated air into the flow path at a position that is proximate a first side of the air moving device and restricting the introduction of heated air into the flow path at a position that is proximate a second side of the air moving device while the air moves in the first direction along the flow path, and introducing heated air into the flow path at the position that is proximate the second side of the air moving device and restricting the introduction of heated air into the flow path at the position that is proximate the first side of the air moving device while the air moves in the second direction along the flow path.

30. A method of operating a kiln system, the method comprising:

introducing a charge of lumber into a kiln chamber;

alternately operating at least one air moving device to move air in a first direction along a flow path within the kiln chamber and to move air along the flow path in a second direction that is opposite from the first direction;

introducing heated air from a furnace into the flow path at a position that is proximate a first side of the air moving device while the air moves in the first direction along the flow path, wherein the air moving device has a high pressure side and a low pressure side while the air moves in the first direction along the flow path, and the first side of the air moving device is the high pressure side while the air moves in the first direction along the flow path; and introducing heated air from the furnace into the flow path at a position that is proximate a second side of the air moving device while the air moves in the second direction along the flow path, wherein the air moving device has a high pressure side and a low pressure side while the air moves in the second direction along the flow path, and the second side of the air moving device is the high pressure side while the air moves in the second direction along the flow path, wherein the introducing is carried out so that the amount of heated air supplied to the high pressure side of the air moving device is greater than any amount of air supplied to the low pressure side of the air moving device while the air moves in the first direction along the flow path, and while the air moves in the second direction along the flow path.

31. A method according to claim 30, wherein the introducing heated air from the furnace comprises operating an air moving device associated with the furnace in the same direction while the air moves in the first direction along the flow path, and while the air moves in the second direction along the flow path.

32. A method of operating a kiln system, the method comprising:

introducing a charge of lumber into a kiln chamber;

alternately operating at least one air moving device to move air in a first direction along a flow path within the kiln chamber and to move air along the flow path in a second direction that is opposite from the first direction; and operating a damper control system so that:

heated air is introduced from a first side of a passageway into the flow path while air moves in the first direction along the flow path, heated air is introduced from a second side of the passageway into the flow path while the air moves in the second direction along the flow path, the amount of heated air supplied from the first side of the passageway is greater than any amount of air supplied from the second side of the passageway while air moves in the first direction along the flow path, and the amount of heated air supplied from the second side of the passageway is greater than any amount of air supplied from the first side of the passageway while air moves in the second direction along the flow path.

33. A method according to claim 30, further comprising introducing heated air from a furnace to the passageway, with the introducing heated air comprising operating an air moving device associated with the furnace in the same direction while the air moves in the first direction along the flow path, and while the air moves in the second direction along the flow path.

* * * * *

UNITED STATES PATENT AND TRADEMARK OFFICE

CERTIFICATE OF CORRECTION

PATENT NO. : 6,370,792 B1
DATED : April 16, 2002
INVENTOR(S) : Culp et al.

It is certified that error appears in the above-identified patent and that said Letters Patent is hereby corrected as shown below:

Title page, Item [54] and Column 1,
Lines 1-3, in the title, "STRUCTURE AND METHODS FOR INTRODUCING HEATED ARI INTO A KILN CHAMBER" should read -- STRUCTURES AND METHODS FOR INTRODUCING HEATED AIR INTO A KILN CHAMBER --.

Column 18,
Line 66, after "magnitude" insert -- of the radius --.

Signed and Sealed this

Twenty-fourth Day of September, 2002

*Attest:*

*Attesting Officer*

JAMES E. ROGAN
*Director of the United States Patent and Trademark Office*